US007024964B2

(12) United States Patent
Fukuchi

(10) Patent No.: US 7,024,964 B2
(45) Date of Patent: Apr. 11, 2006

(54) HYDRAULIC DRIVE DEVICE UTILIZING ELECTRIC MOTOR

(75) Inventor: Kazuyoshi Fukuchi, 5-22-23, Tagami, Kagoshima-shi, Kagoshima, 890-0034 (JP)

(73) Assignee: Kazuyoshi Fukuchi, Kagoshima (JP)

( * ) Notice: Subject to any disclaimer, the term of this patent is extended or adjusted under 35 U.S.C. 154(b) by 0 days.

(21) Appl. No.: 10/743,027

(22) Filed: Dec. 23, 2003

(65) Prior Publication Data

US 2004/0261571 A1 Dec. 30, 2004

(30) Foreign Application Priority Data

Dec. 25, 2002 (JP) ..... 2002-374071
Oct. 23, 2003 (JP) ..... 2003-363127

(51) Int. Cl.
*F16H 47/00* (2006.01)

(52) U.S. Cl. ..... 74/730.1

(58) Field of Classification Search ..... 74/730.1; 60/419

See application file for complete search history.

(56) References Cited

U.S. PATENT DOCUMENTS 3,379,008 A * 4/1968 Manganaro ..... 180/302
3,665,788 A * 5/1972 Nyman ..... 475/72
3,948,047 A * 4/1976 Gilbert ..... 60/325
4,663,937 A * 5/1987 Cullin ..... 60/431

FOREIGN PATENT DOCUMENTS

| | | |
|---|---|---|
| JP | 48-46102-01 | 10/1946 |
| JP | 57-211397 A | 12/1982 |
| JP | 59-10348 | 4/1984 |
| JP | 1-121758 | 8/1989 |
| JP | 8-48169 A | 2/1996 |
| JP | 10-82325 A | 3/1998 |
| JP | 11-165995 A | 6/1999 |
| JP | 2001/200811 | 7/2001 |
| JP | 2002/276648 | 9/2002 |
| WO | WO 02/103222 A1 | 12/2002 |

* cited by examiner

*Primary Examiner*—Dirk Wright
(74) *Attorney, Agent, or Firm*—Sughrue Mion, PLLC

(57) ABSTRACT

Rotational output of an electric motor is directly connected to a hydraulic pump or a hydraulic motor. The electric motor acts as drive source for a hydraulic drive machine such as hydraulic shovel, bulldozer or that for a generator. A hydraulic drive device utilizing the electric motor includes an electric motor 102, a first rotation transmission device 106 connected to an output shaft 102*a* of the electric motor 102 and performing speed increasing function, a hydraulic pump 108 driven by an output shaft 106*b* of the first rotation transmission device 106, a hydraulic motor 110 where oil from the hydraulic pump 108 is supplied through an operation-switching valve 109, a second rotation transmission device 107 connected to an output shaft 110*a* of the hydraulic motor 110 and performing speed increasing function, and a drive output shaft 125 disposed on the output side of the second rotation transmission device 107.

10 Claims, 6 Drawing Sheets

HYDRAULIC DRIVE DEVICE UTILIZING ELECTRIC MOTOR

BACKGROUND OF THE INVENTION

1. Field of the Invention

The present invention relates to a hydraulic drive device that drives a hydraulic pump and a hydraulic motor utilizing an electric motor as a direct drive source.

2. Description of the Related Art

A gasoline engine or the like has been conventionally used to drive a hydraulic pump or a hydraulic motor and operate a hydraulic shovel, a bulldozer or the like. However, no technique has been proposed to directly connect a rotational output of an electric motor to a hydraulic pump or a hydraulic motor and drive the mentioned hydraulic pump or hydraulic motor as a drive source of a hydraulic drive machine such as hydraulic shovel or bulldozer. This is because it has been considered that output of the electric motor is not high enough to be used as a direct drive source power for driving the hydraulic pump or the hydraulic motor and is deficient to operate the hydraulic drive machine such as hydraulic shovel or bulldozer.

SUMMARY OF THE INVENTION

Accordingly, it is an object of the present invention to provide a hydraulic drive device capable of saving energy consumption. In this hydraulic drive device, rotational output of an electric motor is directly connected to a hydraulic pump or a hydraulic motor to drive the hydraulic pump or the hydraulic motor, utilizing the electric motor as a drive source for a hydraulic drive machine such as hydraulic shovel, bulldozer or as a drive source for a generator.

To accomplish the foregoing object, a hydraulic drive device utilizing an electric motor according to this invention includes: an electric motor; a first rotation transmission device that is connected to an output shaft of the mentioned electric motor and performs speed increasing function; a hydraulic pump driven by rotation of an output shaft of the mentioned first rotation transmission device; a hydraulic motor in which oil from the mentioned hydraulic pump is supplied through an operation-switching valve; a second rotation transmission device that is connected to an output shaft of the mentioned hydraulic motor and performs speed-increasing function; and a drive output shaft disposed on the output side of the mentioned second rotation transmission device.

As a result of above construction, it becomes possible to directly connect a rotational output of an electric motor to a hydraulic pump or a hydraulic motor to drive the mentioned hydraulic pump or hydraulic motor, and utilize the electric motor as a drive source for a hydraulic drive machine such as hydraulic shovel or bulldozer or as a drive source for a generator.

Another hydraulic drive device utilizing an electric motor according to this invention includes: an electric motor; a hydraulic pump driven by rotation of an output shaft of the mentioned electric motor; a hydraulic motor in which oil from the mentioned hydraulic pump is supplied through an operation-switching valve; a rotation transmission device that is connected to an output shaft of the mentioned hydraulic motor and performs speed increasing function; and a drive output shaft disposed on the output side of the mentioned rotation transmission device.

As a result of above construction, it becomes possible to directly connect a rotational output of an electric motor to a hydraulic pump or a hydraulic motor to drive the mentioned hydraulic pump or hydraulic motor, and utilize the electric motor as a drive source for a hydraulic drive machine such as hydraulic shovel or bulldozer or as a drive source for a generator.

The mentioned rotation transmission device is preferably provided with: an input shaft; a rotating body that is connected to the mentioned input shaft, acts by itself as a flywheel, and on the output side of which an internal gear is formed; and a gear mechanism for transmitting rotation of the mentioned rotating body to a drive output shaft disposed on an output shaft gear by allowing counter gears to mesh with the mentioned internal gear and the output shaft gear to mesh with these counter gears. A protrusion is formed on either the outer circumference of the mentioned rotating body or a stationary frame, and a recess surrounding the mentioned protrusion is formed on the other.

Since the rotating body itself functions as a flywheel, even if a motor such as hydraulic motor or pneumatic motor easy to vary in number of rotations is connected to the input side, the variation in rotation and vibration of the rotating motor can be absorbed, whereby a stable rotating speed can be obtained (rotating speed stabilizing function). Further, it is possible to freely change rotating speed ratio by changing number of the counter gears or diameter of the counter gears and that of the output shaft gear (rotating speed change function). Furthermore, since the mentioned rotating speed stabilization function and the rotating speed change function can be incorporated in the rotating body, the entire device can be made considerably compact.

The mentioned rotation transmission device is preferably provided with: an input shaft; a rotating body that is connected to the mentioned input shaft, acts by itself as a flywheel, and on the output side of which an internal gear is formed; and a gear mechanism for transmitting rotation of the mentioned rotating body to a drive output shaft disposed on an output shaft gear by allowing the output shaft gear to mesh with the mentioned internal gear. A protrusion is formed on either the outer circumference of the mentioned rotating body or a stationary frame, and a recess surrounding the mentioned protrusion is formed on the other.

Since the rotating body itself functions as a flywheel, even if a motor such as hydraulic motor or pneumatic motor easy to vary in number of rotations is connected to the input side, the variation in rotation and vibration of the rotating motor can be absorbed, whereby a stable rotating speed can be obtained (rotating speed stabilizing function). Further, since the mentioned rotating speed stabilization function can be incorporated in the rotating body, the entire device can be made considerably compact.

Further, the hydraulic drive device utilizing an electric motor preferably contains a generator driven by rotation of the mentioned drive output shaft and a battery charged with electric power generated by the mentioned generator, and the mentioned electric motor is driven by the power of the battery.

Furthermore, plural sets of the mentioned generator and battery are preferably disposed, and as long as a battery of any one set is working, a battery of the other set is charged with electric power.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Embodiment 1

Figure 1:
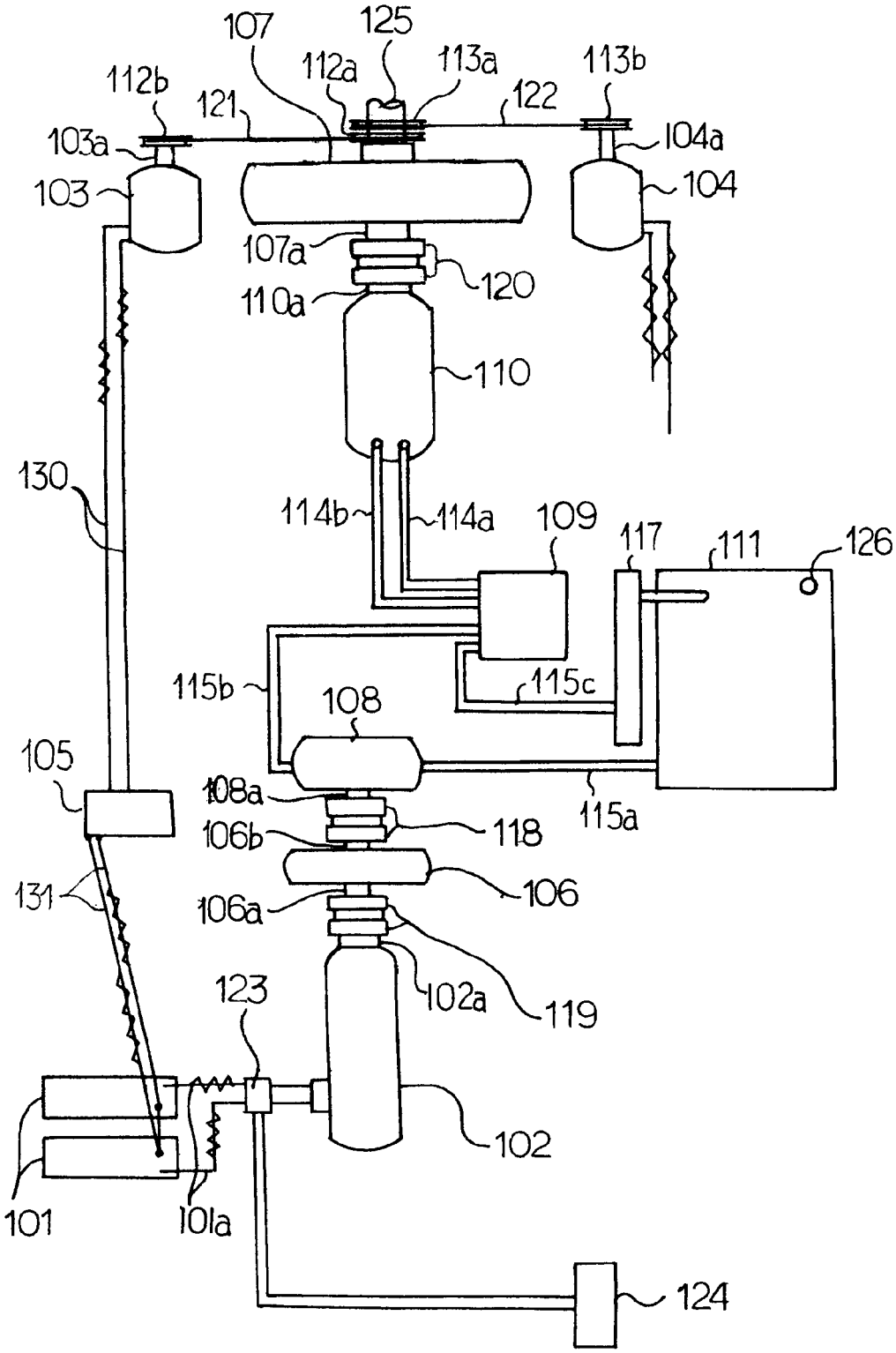
FIG. 1 is a block diagram showing a constitution of a hydraulic drive source utilizing an electric motor according to Embodiment 1 of the present invention.

With reference to FIG. 1 showing a block diagram of a hydraulic drive source utilizing an electric motor according to Embodiment 1 of the invention, first, a structure of the hydraulic drive source utilizing an electric motor is hereinafter described. Referring to FIG. 1, an output line 101*a* of a battery 101 is connected to an electric motor 102 through a socket 123. A switch 124 has an output line connected to the mentioned socket 123, and acts as a driving switch of the electric motor 102. An output shaft 102*a* of the electric motor 102 is connected to an input shaft 106*a* of a first rotation transmission mechanism 106 through a coupling 119. An output shaft 106*b* of the first rotation transmission mechanism 106 is connected to an input shaft 108*a* of a hydraulic pump 108 through a coupling 118. An oil tank 111 supplies oil to the hydraulic pump 108 through a hydraulic hose 115*a*, and the hydraulic pump 108 supplies oil to an operation-switching valve 109 through a hydraulic hose 115*b*. A part of the oil in the operation-switching valve 109 returns to the oil tank 111 through the hydraulic hose 115 and a cooler 117. The oil tank 111 is provided with an air cock 126.

The operation-switching valve 109 is provided with a switch not shown, and when turning on this switch, high-pressure oil is supplied to a hydraulic hose 114*a* through a nozzle built in the operation-switching valve 109. A hydraulic motor 110 is connected to the output side of the hydraulic hose 114*a*, and oil in the hydraulic motor 110 flows back to the operation-switching valve 109 through a hydraulic hose 114*b*. An output shaft 110*a* of the hydraulic motor 110 is connected to an input shaft 107*a* of a second rotation transmission device 107 through a coupling 120. A drive output shaft 125 acts as an output shaft of the second rotation transmission device 107. Pulleys 112*a* and 113*a* are connected to this drive output shaft 125. Pulleys 112*b* and 113*b* are connected to input shafts 103*a* and 104*a* of generators 103 and 104 respectively. A belt 121 is wrapped around the pulleys 112*b* and 112*a*, and a belt 122 is wrapped around the pulleys 113*b* and 113*a*. An output line 130 of the generator 103 is connected to a regulator 105, and an output line 131 of the regulator 105 is connected to the mentioned battery 101. In the same manner, an output line of the generator 104 is connected to a regulator not shown, and this regulator is connected to a battery not shown.

Figure 2:
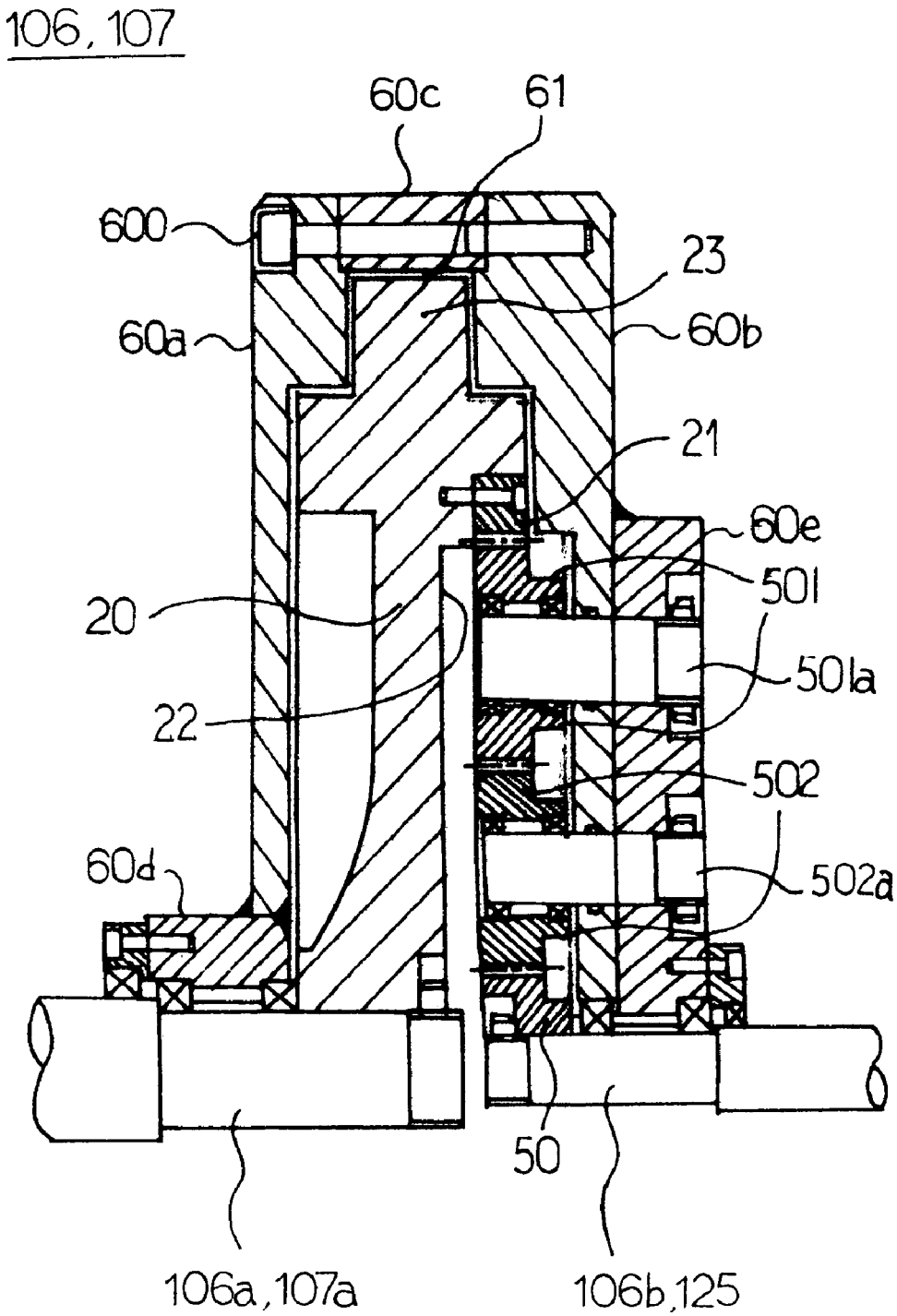
FIG. 2 is a partially sectional side view showing a rotation transmission device used in Embodiment 1 of the invention.

Now, structure of the mentioned first and second rotation transmission devices is hereinafter described. FIG. 2 is a partially sectional view showing a side view of the rotation transmission device 106, 107. In the drawing, the input shaft 106*a*, 107*a* of the rotation transmission device 106, 107 is pivotally supported by a part 60*d* of a housing of the rotation transmission device, and is connected to a rotating body 20 in the rotation transmission device. This rotating body 20 is made of steel and manufactured by, for example, forging or casting, has a predetermined inertial mass W, and acts as a flywheel by itself. A recess 22 is provided on the output side of the rotating body 20, and an internal gear 21 is disposed on the recess 22. A protrusion 23 is formed on the outer circumference of the rotating body 20, and this protrusion 23 is accommodated in a recess 61 surrounded by stationary housings 60*a*, 60*b* and 60*c*. The protrusion 23 of the rotating body 20 is regulated by the housings, and this construction makes it possible to prevent the rotating body 20 itself from instable rotation in axial direction as well as in radial direction. The housings 60*a*, 60*b* and 60*c* are fixed with a bolt 600.

The internal gear 21 disposed on the recess 22 of the rotating body 20 is provided with a first counter gear 501 meshing with the internal gear 21 and a second counter gear 502 meshing with the first counter gear 501, and an output shaft gear 50 is allowed to mesh with the second counter gear 502. The output shaft gear 50 is fixed to the output shaft 106*b*, 125 of the rotation transmission device 106, 107. Shafts 501*a* and 502*a* of the first and second counter gears 501 and 502 are fixed to a stationary frame 60*e*, and the first and second counter gears 501 and 502 are rotatably disposed on these shafts 501*a* and 502*a*.

Now, operation of the hydraulic drive source utilizing an electric motor according to this embodiment is hereinafter described. First, when turning the switch 124 on, the battery 101 is connected to the electric motor 102 through the socket 123, thereby the output shaft 102*a* of the electric motor 102 coming to rotate. The rotation of the output shaft 102*a* is transmitted to the input shaft 106*a* of the first rotation transmission device 106 through the coupling 119.

In the first rotation transmission device 106, the rotating body 20 rotates through the input shaft 106*a*. The rotating body 20 having a predetermined inertial mass W accumulates rotational energy generated by the electric motor 102 and rotates at a stable rotating speed. The recess 61 of the stationary housings regulates the protrusion 23 on the outer circumference of the rotating body 20. Therefore, the rotating body 20 is prevented from instable rotation in axial direction and in radial direction, and the rotating body 20 rotates more stably. The rotation of the rotating body 20 is transmitted to the first counter gear 501 through the internal gear 21, transmitted from the first counter gear 501 to the second counter gear 502, and finally speed-increased and transmitted to the output shaft gear 50. The rotation of the output shaft gear 50 is outputted to the output shaft 106*b*.

The rotation of the output shaft 106*b* of the first rotation transmission device 106 is transmitted to the input shaft 108*a* of the hydraulic pump 108 through the coupling 118. Owing to the rotation of the input shaft 108*a* of the hydraulic pump 108, the hydraulic pump 108 sucks oil from the oil tank 111 through the hydraulic hose 115, and discharges the oil into the operation-switching valve 109 through the hydraulic hose 115*b*.

In an operation-switching valve 109, when turning on a switch not shown at the time the oil pressure has increased to a predetermined, the high-pressure oil in the operation-switching vale 109 is supplied to the hydraulic hose 114*a* through the built-in nozzle. The hydraulic motor 110 rotates the output shaft 110*a* with the oil pressure supplied from the operation-switching valve 19. In addition, the oil in the hydraulic motor 110 flows back to the operation-switching valve 109 through the hydraulic hose 114*b*. The excess oil in the operation-switching valve 109 returns to the oil tank 111 through a hydraulic hose 115*c* and cooler 117.

The rotation of the output shaft 110*a* of the hydraulic motor 110 is transmitted to the input shaft 107*a* of the second rotation transmission device 107 through the coupling 120.

In the second rotation transmission device 107, the rotating body 20 rotates through the input shaft 107*a*. The rotating body 20 having a predetermined inertial mass W accumulates rotational energy generated in the hydraulic motor 110 and rotates at a stable rotating speed. The recess 61 of the stationary housings regulates the protrusion 23 on the outer circumference of the rotating body 20. Therefore, the rotating body 20 is prevented from instable rotation in axial direction and in radial direction, thus the rotating body 20 rotates more stably. The rotation of the rotating body 20 is transmitted to the first counter gear 501 through the internal gear 21, transmitted from the first counter gear 501 to the second counter gear 502, and finally speed-increased and transmitted to the output shaft gear 50. The rotation of the output shaft gear 50 is outputted to the output shaft 125. In particular, the second rotation transmission device 107 has an advantage of absorbing and restraining variation in number of rotations of the hydraulic motor 110 and phenomenon of blow.

The output shaft 125 of the second rotation transmission device 107 acts as a drive source of a hydraulic drive machine such as hydraulic shovel or bulldozer. The rotation of the output shaft 125 is transmitted through the pulley 112*a*, the belt 121, and the pulley 112*b*, and rotates the input shaft 103*a* of the generator 103. The rotation of the output shaft 125 is further transmitted through the pulley 113*a*, the belt 122, and the pulley 113*b*, and rotates the input shaft 104*a* of the generator 104. The generator 103 generates electric power through the rotation of the input shaft 103*a*, and the battery 101 is charged with this electric power through the connecting line 130, the regulator 105 and the connecting line 131. In the same manner, a battery not shown is charged with electric power from the generator 104. In addition, it is also preferable to arrange so that as long as one battery is charged with electric power from the generator 103 or the generator 104, the other battery continues to drive the mentioned electric motor 102.

EXAMPLE

A practical example of the hydraulic drive device utilizing an electric motor according to the foregoing embodiment is going to be described below. First, two batteries of 12V power supply are arranged to act as the battery 101. A dc motor of 24V, 2.5 kW is employed as the electric motor 102. A rotation transmission device of approximately 250 mm in diameter is used as the first rotation transmission device 106, and the output rotation of the direct current motor, which is approximately 250 rpm, is speed increased to approximately 1250 rpm. The pressure of oil discharged from the operation-switching valve 109 is approximately 180 to 200 kgf/cm$^2$, and capacity of the oil tank 110 is approximately 100 l. A rotation transmission device of approximately 465 mm in diameter is used as the second rotation transmission device 107, and the output rotation of the hydraulic motor, which is approximately 750 rpm, is speed increased to approximately 3700 rpm.

Embodiment 2

Figure 3:
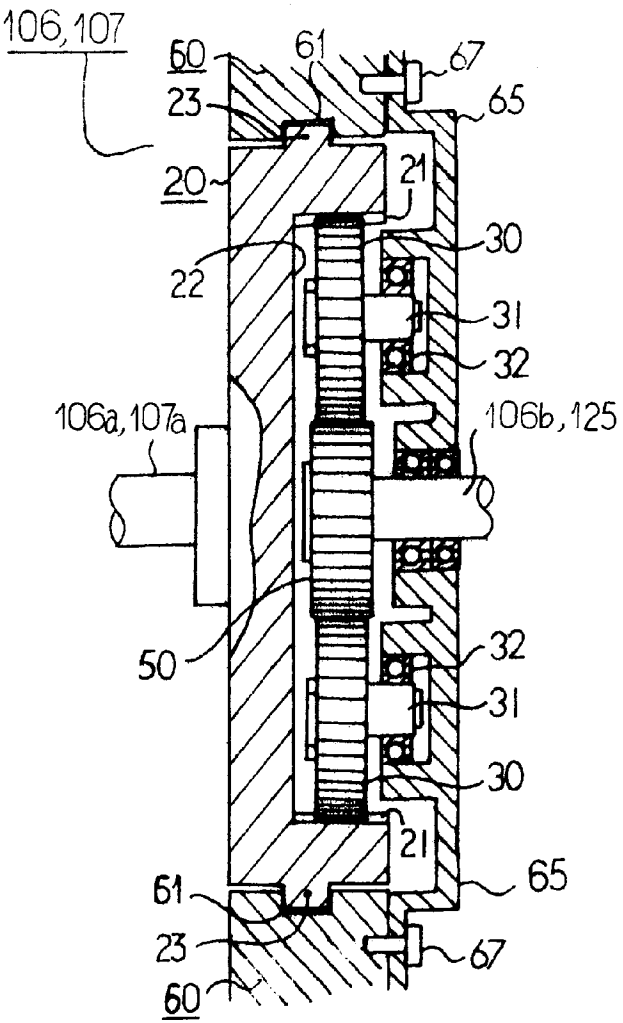
FIG. 3 is a partially sectional side view showing a rotation transmission device used in Embodiment 2 of the invention.

FIG. 3 is a sectional side view showing the first or second rotation transmission device 106, 107 used in this Embodiment 2 of the invention. In this rotation transmission device 106, 107, the rotation drive force of the input shaft 106*a*, 107*a* is transmitted to the rotating body 20 connected to this input shaft. This rotating body 20 is made of steel and manufactured by, for example, forging or casting, has a predetermined inertial mass W, and functions as a flywheel by itself. A recess 22 is formed on the output side of the rotating body 20, and an internal gear 21 is provided-on a sidewall of the recess 22 by cutting. A protrusion 23 is formed on the outer circumference of the rotating body 20, and a recess 61 formed on a stationary frame 60 regulates this protrusion 23.

Figure 4:
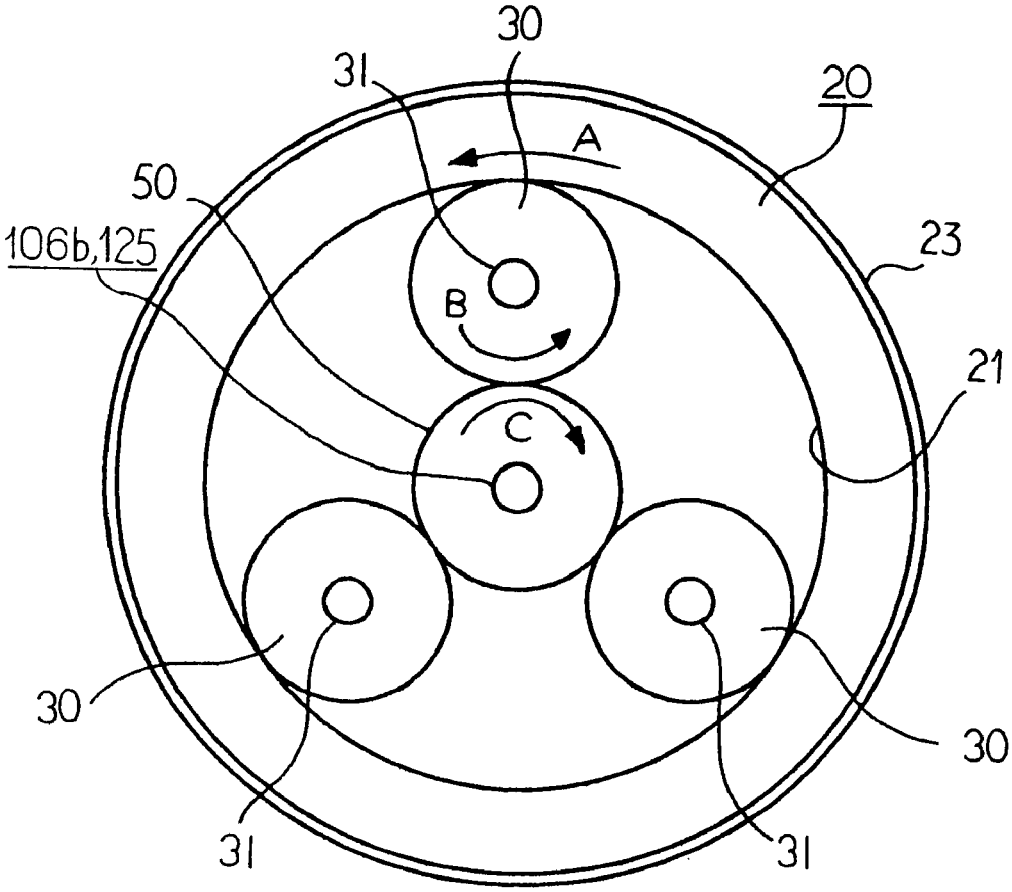
FIG. 4 is a schematic view showing a gear mechanism of the rotation transmission device used in Embodiment 2 of the invention.

FIG. 4 is a schematic view showing from output side a gear mechanism disposed in the internal gear of the mentioned rotating body 20, and in which counter gears 30 are in mesh with the internal gear 21 and the output shaft gear 50. The three counter gears 30 are in mesh with the internal gear 21 of the mentioned rotating body 20 as planet gears. These three counter gears 30 are disposed at approximately 120 degrees from each other around the center of the rotating body 20. Shafts 31 of the counter gears 30 are rotatably disposed to a fixed plate 65 through bearings 32. The fixed plate 65 is fixed to the stationary frame 60 with bolts 67. The output shaft gear 50 meshing with these counter gears 30 is disposed at the center of the three counter gears 30, and the output shaft 106*b*, 125 is connected with this output shaft gear 50.

Referring to FIG. 4, the rotation of the rotating body 20 (indicated by the arrow A in FIG. 4) is transmitted to the counter gear 30 through the internal gear 21 (indicated by the arrow B in FIG. 4), and is transmitted to the output shaft gear 50 through this counter gear 30 (indicated by the arrow C in FIG. 4). The rotation of the output shaft gear 50 is outputted through the output shaft 106*b*, 125.

Modifications

Figure 5:
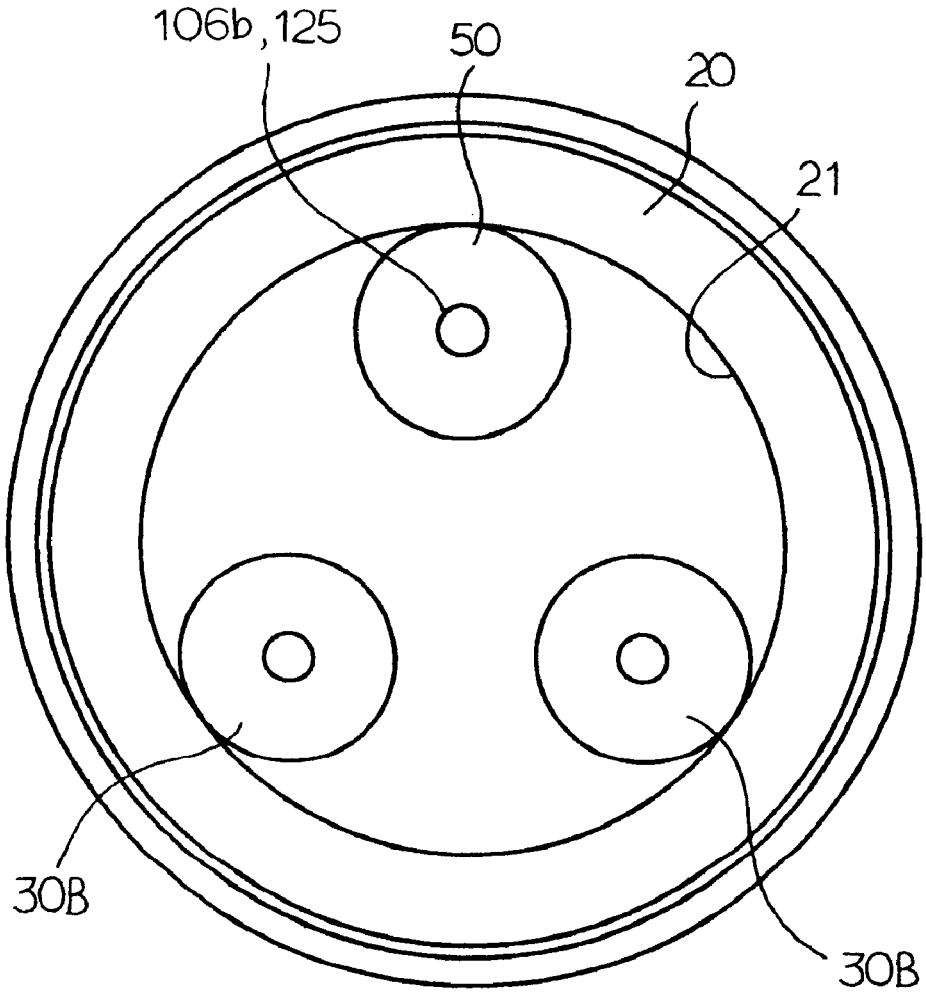
FIG. 5 is a schematic view showing a gear mechanism of a rotation transmission device used in a further embodiment of the invention.

In the foregoing embodiments, the rotation force of the rotating body 20 is transmitted to the output shaft gear through the counter gears. It is also preferable that, as shown in FIG. 5, the output shaft gear 50 is allowed to directly mesh with the internal gear 21 of the rotating body 20 and the rotation force is directly transmitted from the rotating body 20 to the output shaft 51. In addition, gears 30B meshing with the internal gear 21 are disposed in order to stabilize rotation of the rotating body 20.

In the foregoing embodiments, the protrusion 23 is formed on the outer circumference of the rotating body 20 in order to regulate axial movement of the rotating body 20, and the recess 61 on the stationary frame regulates this protrusion 23 in order to prevent the rotating body 20 from moving in the axial direction. It is also preferable that a recess is provided on the outer circumference of the rotating body 20 to be regulated by a protrusion on the stationary frame.

In the foregoing embodiments, the first rotation transmission device 106 is disposed on the output side of the electric motor 102. It is also preferable that the first rotation transmission device 106 is omitted and the hydraulic pump 108 is directly driven by output rotation of the electric motor 102 in the case that the electric motor 102 has a large capacity.

Figure 6:
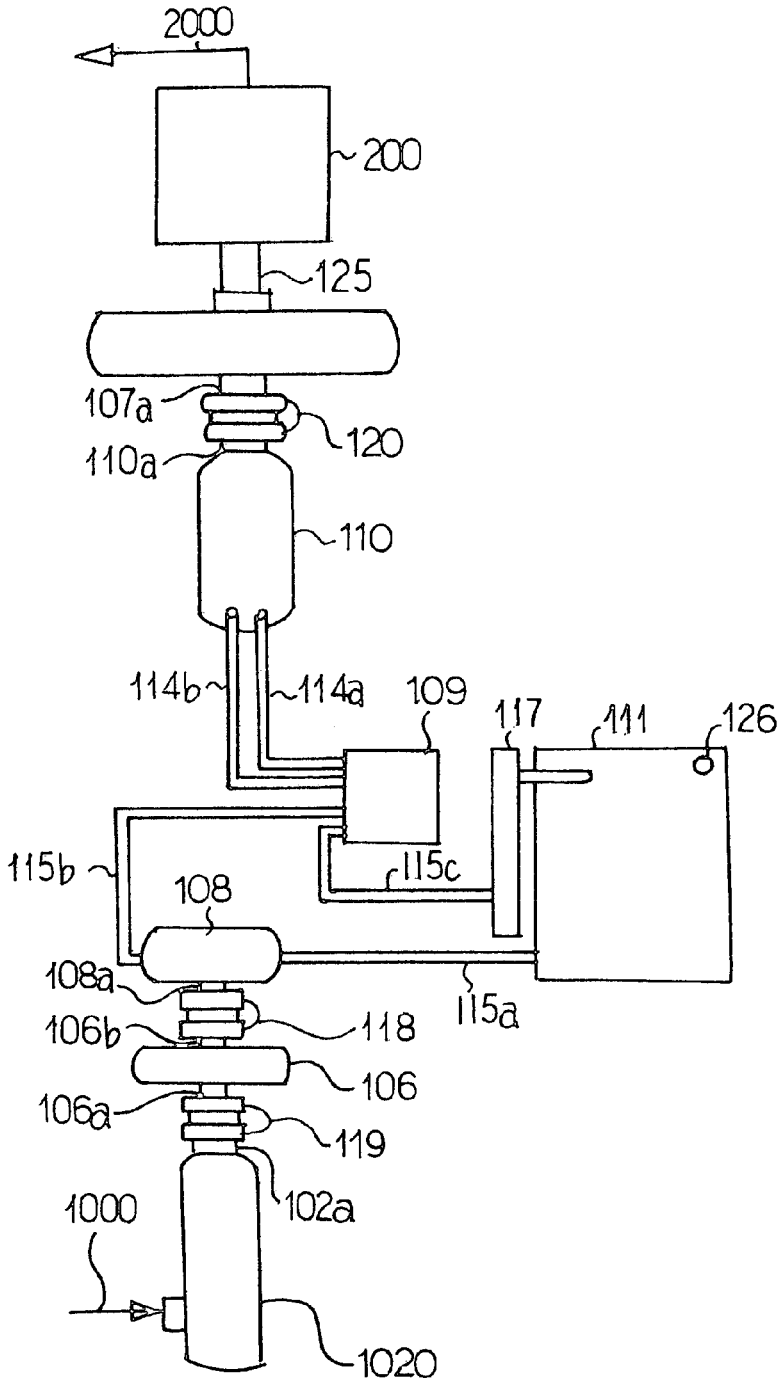
FIG. 6 is a block diagram showing a hydraulic drive source utilizing an electric motor according to the further embodiment of the invention.

Further, in the foregoing embodiments, the electric motor 102 is rotated and driven by the battery 101 as shown in FIG. 1. It is also preferable to use ac power 1000 and rotate and drive an ac motor 1020 acting as an electric motor as shown in FIG. 6. The rest of the construction and operation in FIG. 6 are the same as those in the foregoing Embodiment 1 (FIG. 1). In addition, the drive output shaft 125 of the second rotation transmission device 107 is directly connected to an input shaft of a generator 200 so that the generator 200 generates electric power 2000.

While the presently preferred embodiments of the present invention have been shown and described.

It is to be understood that these disclosures are for the purpose of illustration and that various changes and modifications may be made without departing from the scope of the invention as set forth in the appended claims.

What is claimed is:

1. A hydraulic drive device utilizing an electric motor comprising:

an electric motor;

a first rotation transmission device that is connected to an output shaft of said electric motor and performs speed increasing function;

a hydraulic pump driven by rotation of an output shaft of said first rotation transmission device;

a hydraulic motor in which oil from said hydraulic pump is supplied through an operation-switching valve;

a second rotation transmission device that is connected to an output shaft of said hydraulic motor and performs speed-increasing function; and a drive output shaft disposed on the output side of said second rotation transmission device, wherein said rotation transmission device comprises an input shaft;

a rotating body that is connected to said input shaft, acts by itself as a flywheel, and on the output side of which an internal gear is formed; and a gear mechanism for transmitting rotation of said rotating body to a drive output shaft disposed on an output shaft gear by allowing counter gears to mesh with said internal gear and the output shaft gear to mesh with these counter gears;

wherein a protrusion is formed on either the outer circumference of said rotating body or a stationary frame, and a recess surrounding said protrusion is formed on the other.

2. A hydraulic drive device utilizing an electric motor comprising:

an electric motor;

a hydraulic pump driven by rotation of an output shaft of said electric motor;

a hydraulic motor in which oil from said hydraulic pump is supplied through an operation-switching valve;

a rotation transmission device that is connected to an output shaft of said hydraulic motor and performs speed increasing function; and a drive output shaft disposed on the output side of said rotation transmission device, wherein said rotation transmission device comprises an input shaft:

a rotating body that is connected to said input shaft, acts by itself as a flywheel, and on the output side of which an internal gear is formed; and a gear mechanism for transmitting rotation of said rotating body to a drive output shaft disposed on an output shaft gear by allowing counter gears to mesh with said internal gear and the output shaft gear to mesh with these counter gears;

wherein a protrusion is formed on either the outer circumference of said rotating body or a stationary frame, and a recess surrounding said protrusion is formed on the other.

3. A hydraulic drive device utilizing an electric motor comprising:

an electric motor;

a first rotation transmission device that is connected to an output shaft of said electric motor and performs speed increasing function;

a hydraulic pump driven by rotation of an output shaft of said first rotation transmission device;

a hydraulic motor in which oil from said hydraulic pump is supplied through an operation-switching valve;

a second rotation transmission device that is connected to an output shaft of said hydraulic motor and performs speed-increasing function; and a drive output shaft disposed on the output side of said second rotation transmission device, wherein said rotation transmission device comprises an input shaft;

a rotating body that is connected to said input shaft, acts by itself as a flywheel, and on the output side of which an internal gear is formed; and a gear mechanism for transmitting rotation of said rotating body to a drive output shaft disposed on an output shaft gear by allowing the output shaft gear to mesh with said internal gear;

wherein a protrusion is formed on either the outer circumference of said rotating body or a stationary frame, and a recess surrounding said protrusion is formed on the other.

4. A hydraulic drive device utilizing an electric motor comprising:

an electric motor;

a hydraulic pump driven by rotation of an output shaft of said electric motor;

a hydraulic motor in which oil from said hydraulic pump is supplied through an operation-switching valve;

a rotation transmission device that is connected to an output shaft of said hydraulic motor and performs speed increasing function; and a drive output shaft disposed on the output side of said rotation transmission device, wherein said rotation transmission device comprises an input shaft;

a rotating body that is connected to said input shaft, acts by itself as a flywheel, and on the output side of which an internal gear is formed; and a gear mechanism for transmitting rotation of said rotating body to a drive output shaft disposed on an output shaft gear by allowing the output shaft gear to mesh with said internal gear;

wherein a protrusion is formed on either the outer circumference of said rotating body or a stationary frame, and a recess surrounding said protrusion is formed on the other.

5. The hydraulic drive device utilizing an electric motor according to claim 1, wherein the hydraulic drive device utilizing an electric motor comprises a generator driven by rotation of said drive output shaft and a battery charged with electric power generated by said generator, and said electric motor is driven by the power of the battery.

6. The hydraulic drive device utilizing an electric motor according to claim 2, wherein the hydraulic drive device utilizing an electric motor comprises a generator driven by rotation of said drive output shaft and a battery charged with electric power generated by said generator, and said electric motor is driven by the power of the battery.

7. The hydraulic drive device utilizing an electric motor according to claim 5, wherein plural sets of said generator and battery are disposed, and as long as a battery of any one set is working, a battery of the other set is charged with electric power.

8. The hydraulic drive device utilizing an electric motor according to claim 6, wherein plural sets of said generator and battery are disposed, and as long as a battery of any one set is working, a battery of the other set is charged with electric power.

9. A hydraulic drive device utilizing an electric motor comprising:

an electric motor;

a first rotation transmission device that is connected to an output shaft of said electric motor and performs speed increasing function;

a hydraulic pump driven by rotation of an output shaft of said first rotation transmission device;

a hydraulic motor in which oil from said hydraulic pump is supplied through an operation-switching valve;

a second rotation transmission device that is connected to an output shaft of said hydraulic motor and performs speed-increasing function; and a drive output shaft disposed on the output side of said second rotation transmission device, wherein the hydraulic drive device utilizing an electric motor comprises a generator driven by rotation of said drive output shaft and a battery charged with electric power generated by said generator, and said electric motor is driven by the power of the battery, and wherein plural sets of said generator and battery are disposed, and as long as a battery of any one set is working, a battery of the other set is charged with electric power.

10. A hydraulic drive device utilizing an electric motor comprising:

an electric motor;

a hydraulic pump driven by rotation of an output shaft of said electric motor;

a hydraulic motor in which oil from said hydraulic pump is supplied through an operation-switching valve;

a rotation transmission device that is connected to an output shaft of said hydraulic motor and performs speed increasing function; and a drive output shaft disposed on the output side of said rotation transmission device, wherein the hydraulic drive device utilizing an electric motor comprises a generator driven by rotation of said drive output shaft and a battery charged with electric power generated by said generator, and said electric motor is driven by the power of the battery, and wherein plural sets of said generator and battery are disposed, and as long as a battery of any one set is working, a battery of the other set is charged with electric power.

* * * * *